United States Patent [19]

Fischer et al.

[11] Patent Number: 4,777,912

[45] Date of Patent: Oct. 18, 1988

[54] CAST ENGINE BLOCK FOR LIQUID-COOLED INTERNAL COMBUSTION ENGINES WITH V-SHAPED CYLINDER ARRANGEMENT

[75] Inventors: Adolf Fischer, Haar; Helmut Wimmer, Heimstetten, both of Fed. Rep. of Germany

[73] Assignee: Bayerische Motoren Werke Aktiengesellschaft, Munich, Fed. Rep. of Germany

[21] Appl. No.: 102,372

[22] Filed: Sep. 29, 1987

[30] Foreign Application Priority Data

Sep. 30, 1986 [DE] Fed. Rep. of Germany ..... 3633261

[51] Int. Cl.[4] ..... F01P 3/22

[52] U.S. Cl. ..... 123/41.79; 123/41.74

[58] Field of Search ..... 123/41.47, 41.44, 41.79, 123/41.01, 41.74, 41.82 R, 52 MC, 52 R, 41.29, 41.28, 41.72, 55 VE

[56] References Cited

U.S. PATENT DOCUMENTS

| | | | |
|---|---|---|---|
| 4,212,281 | 7/1980 | Ernest | 123/41.79 |
| 4,279,224 | 7/1981 | Szabo et al. | 123/52 M C |
| 4,382,427 | 5/1983 | Lyndhurst | 123/41.79 |
| 4,401,061 | 8/1983 | Matsushita et al. | 123/41.79 |
| 4,616,600 | 10/1986 | Hirano | 123/41.79 |
| 4,640,236 | 2/1987 | Nakano et al. | 123/41.79 |

*Primary Examiner*—Raymond A. Nelli
*Attorney, Agent, or Firm*—Barnes & Thornburg

[57] ABSTRACT

In a cast engine block for liquid-cooled internal combustion engines with V-shaped cylinder arrangement, the cylinders are arranged in cooling medium spaces delimited by cylinder blocks. A spiral housing 10 of a cooling medium pump 11 having a radial rotor is partially integrated into one of the end walls of the engine block within the area of a cylinder block. A gear box adapted to be fastened at the end wall includes a closure wall corresponding to the end walls surface as well as side walls for the sealing abutment of a separate cover. The other part of the spiral housing inclusive a pressure connection is integrated into the closure wall. This spiral housing includes a collar for the plug-in arrangement of the cooling medium pump. The side wall of the gear box is arranged about the collar receiving the cooling medium pump for an arrangement of the cover separate at the gear box from the cooling medium pump. The pressure connection integrated into the closure wall of the gear box adjoins at a cooling medium line arranged at the tip of the V-space delimited by aperture-free side walls of the cylinder blocks; the cooling medium line is in operative connection with channels for the cooling medium inlet to the cooling medium spaces of the cylinder blocks arranged at the other end of the engine block.

13 Claims, 2 Drawing Sheets

CAST ENGINE BLOCK FOR LIQUID-COOLED INTERNAL COMBUSTION ENGINES WITH V-SHAPED CYLINDER ARRANGEMENT

BACKGROUND AND SUMMARY OF THE INVENTION

The present invention relates to a cast engine block for liquid-cooled internal combustion engines with a V-shaped cylinder arrangement in which a crankcase is connected with cooling medium spaces for cylinder blocks delimiting the cylinders by way of base plates connected with the cylinders.

In a known type of construction, the cylinder blocks arranged V-shaped above the crankcase have relatively low interior side walls which are connected with one another in one piece by an essentially horizontal cover wall. This cover wall is connected with a center longitudinal wall extending in the engine longitudinal direction which is erected above the junction point of the two mutually inclined base plates. This center longitudinal wall includes on both sides ribs protruding into the cooling medium spaces of the cylinder blocks which are arranged essentially in planes of bearing block walls arranged in the crankcase. At the end on the cylinder head side the ribs are operatively connected with cylinder head bolt pipes for fastening the cylinder head. Additioally, the center longitudinal wall is provided with apertures for the connection of the cooling medium spaces.

This construction of the engine block is costly as regards casting techniques. Furthermore, the center longitudinal wall produces on both sides relatively large cooling medium spaces in the cylinder blocks with considerable proportions in the area of the V-space. In a V-engine having an air supply installation arranged in the V-space and exhaust gas lines arranged along the outer side, a relatively large amount of cooling medium is then present in the area of the engine block which is cooler owing to the air feed. A further disadvantage of the prior art construction of the engine block resides in that the cooling medium pump supplies the cooling medium directly into the relatively cool and relatively large proportions of the cooling medium spaces located on both sides of the center longitudinal wall and differing thermal stresses are thus possible between the inner and the outer sides of the V-shaped arranged cylinder blocks.

Finally, a part of the spiral housing of the cooling medium pump is integrated into the end wall within the area of a cylinder block in the prior art construction for reducing the length of the engine block. However, there is no indication in the prior art how the cooling medium pump could be advantageously arranged and construction in relation to an chain- or toothed-belt transmission arranged ahead of the end wall for the drive of the control shafts.

The present invention is concerned with the task to construct an engine block of the aforementioned type with a modified cooling medium conduction system which, for avoiding unequal thermal stresses, permits a preferred admission of hot zones of the engine block, which additionally enables smaller cooling medium spaces in the cylinder blocks with a simple construction from a casting point of view of highly stressable inner side walls of the cylinder block and which finally permits by constructively simple measures a cooling medium pump independently accessible from the chain- or toothed-belt transmission in a V-engine with overhead control shafts driven by the envelope gear.

The underlying problems are solved according to the present invention in that channels for the cooling medium inlet to the cooling medium spaces of the cylinder blocks are arranged at the other end of the engine block remote from the cooling medium pump, in that a cooling medium line connecting the channels with the pressure connection can be arranged between inner side walls of the cylinder blocks free of apertures and connected with the base plates, and in that the cooling medium pump having a radial rotor and a housing including a suction-space and a cooling medium line connection is arranged as plug-in type component in the separate part of the spiral housing.

The cooling medium supply to the engine blocks at the ends remote from the pump enables together with a connecting line between the channels and the cooling medium pump which is arranged in the V-space of the engine block, a free layout and design of the cooling medium spaces in the cylinder blocks, whereby the inner side walls of the cylinder blocks can be constructed free of apertures from the cylinder head side connection to the connection with the base plates. Loads from the cylinder head are transmitted by the side walls by way of the base plates into the bearing block walls of the crankcase with a favorable stress distribution. For achieving a small cooling medium jacket about the cylinders the side walls can additionally be moved closely to the cylinders by means of the separately constructible cooling medium spaces of the cylinder block, whereby the side walls for purposes of self-reinforcement without additional ribs are subdivided into arcuately shaped sections coordinated to the cylinders. If the joint places of two arcuately shaped sections of a side wall are located in a plane of a bearing block wall, then an advantageous force transmission into the bearing block walls of the crankcase is achieved without additional reinforcements by means of the bolt pipes arranged at the joint places for the fastening of the cylinder heads. The described measures provide a simple construction advantageous from a casting point of view for the engine block with a high mechanical loading or stressing capacity of the engine block. This is further enhanced by a cooling medium pump adapted to be assembled by means of a plug-in connection, into the housing of which are integrated further parts of the cooling medium supply.

In one embodiment of the present invention, it is proposed for the channels serving for the supply of the cooling medium into the cooling medium spaces of the cylinder blocks that these channels supply the cooling medium unthrottled at their discharge orifices to relatively hot zones whereas the cooling medium is conducted throttled to the relatively cool zones. This measure serves for achieving uniform thermal stresses in the engine block. For the mutual reinforcement of the V-shaped cylinder blocks, the engine block includes at both ends each in the peak of the V-space a flange with an aperture. The apertues may serve for the arrangement of a separate conduction for the supply of the cooling medium from the pump-side end to the end of the engine block on the side of the clutch connection. However, they may also serve as inflow and outflow openings of a channel formed by sections of the inner side walls and of a closure cover connecting the side walls. For avoiding separate channels, the channels which serve for the cooling medium supply to the cooling medium spaces of the cylinder blocks, according to another feature of the present invention, are formed-in in the end wall of the engine block on the side of the clutch connection and are closed off by means of a common cover adapted to be screwed together with the corresponding flange between the cylinder blocks. The throttling devices provided at the discharge orifice leading to the relatively cool areas of the engine block can be constructed in a simple manner which involves means of the channels constructed as recesses by simple measures from a casting point of view. The flange at the pump side end seves for mechanically relieving a relatively thin closure wall of a gear box with separate cover which is provided for the envelope gear. According to a further feature of the present invention, a part of a spiral housing of the cooling medium pump is integrated into the closure wall whereas the other part of the spiral housing is integrated into the end wall within the area of a cylinder block for achieving a short structural length of the engine block. The cooling medium pump can be located in close proximity, for example, with a chain-or toothed-belt transmission constructed as oil-lubricated chain drive by means of a cylinder block that can be constructed relatively narrow owing to a small cooling medium space. In order to make accessible both functional areas independently of one another, on the one hand, and to avoid a direct mutual sealing of lubricating oil and cooling medium, on the other, the gear box includes within the area of the spiral housing a collar suitable for a plug-in arrangement of the cooling medium pump, and additionally a side wall arranged spaced from the collar for the sealing abutment of the gear box cover. Both functional areas are thus separately accessible in an advantageous manner, whereby for purposes of simplified handling of the plug-in type cooling medium pump, the latter is sealed off with respect to the collar by a conventional O-ring. One functional area is thus accessible without any effect on the sealing medium of the other functional area.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
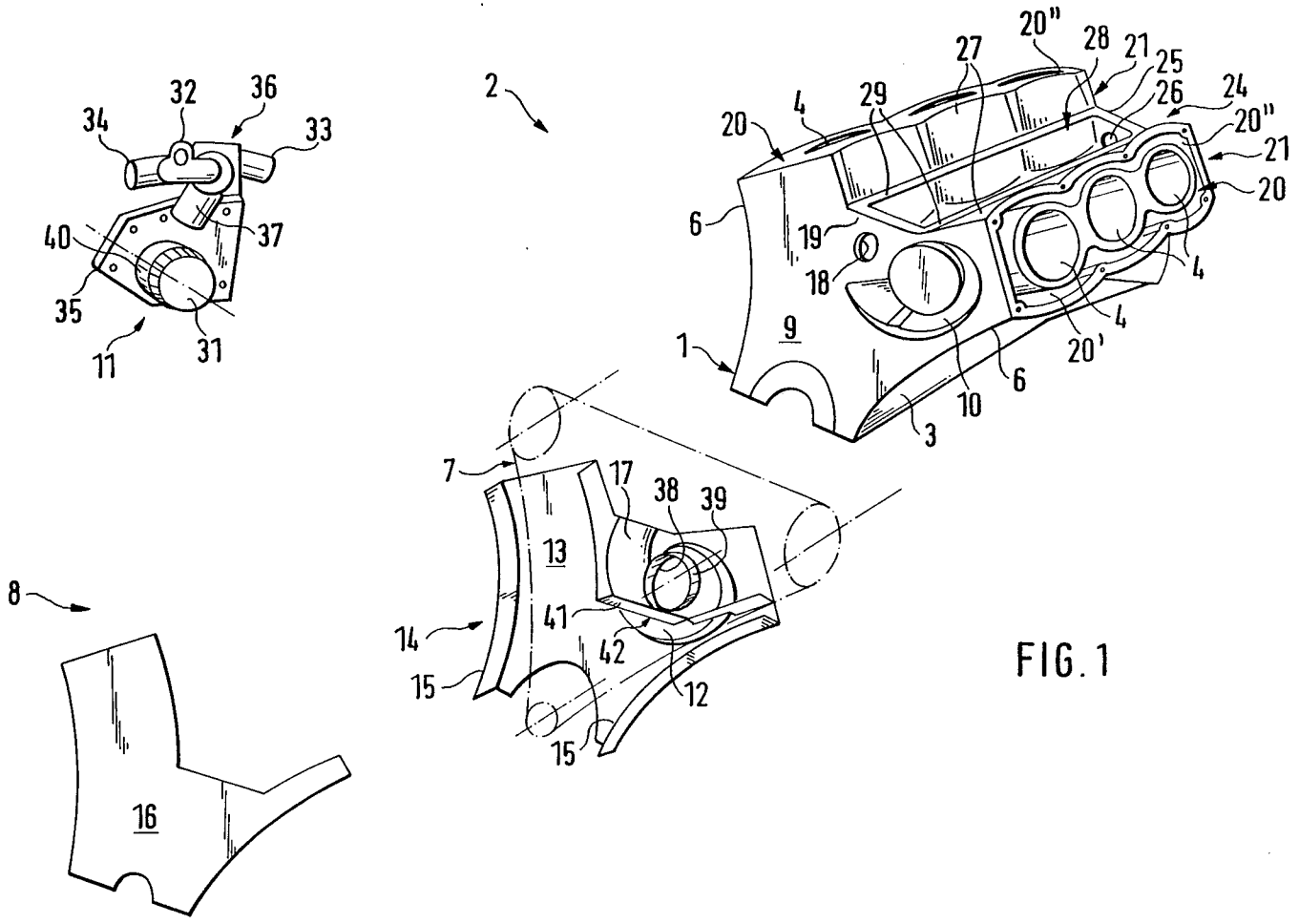
FIG. 1 is a perspective front elevational view of an engine block for a V-shaped engine in accordance with the present invention with individual components illustrated separately.

Referring now to the drawing wherein like reference numerals are used throughout the two views to designate like parts, a cast engine block generally designated by reference numeral 1 for a liquid-cooled internal combustion engine 2 (not illustrated in detail) having a V-shaped cylinder arrangement, includes a crankcase 3 which cooperates with cylinder blocks 6 by way of base plates 5 (FIG. 2) operatively connected with the cylinders 4. Cylinder heads (not shown) constructed according to the cross-flow principle are coordinated to the cylinder blocks 6 whereby the air suction system of the internal combustion engine 2 above the V-space of the engine block 1 is connected to the cylinder heads. The exhaust gas lines of the cylinder heads of the internal combustion engine 2 are arranged along the outer sides. Furthermore, the cylinder heads are equipped with control shafts adapted to be driven by a chain-or toothed-belt transmission generally designated by reference numeral 7 (FIG. 1). A separate transmission housing 8 is provided for the transmission 7.

A spiral housing 10 of a cooling medium pump 11 is partially integrated into a forward end wall 9 of the engine block 1 within the end area of a cylinder block 6. The other part 12 of the spiral housing 10 which closes off the pump is formed in a closure wall 13 of a gear box generally designated by reference numeral 14 of the transmission housing 8. The gear box 14 is detachably secured at the end wall 9 by way of the closure wall 13 corresponding essentially to the area of the end wall 9 of the engine block 1. Furthermore, the gear box 14 includes side walls 15 essentially matched to the outer end wall contours as well as a separate cover 16. Moreover, a pressure connection 17 of the spiral housing 10 is integrated into the closure wall 13 of the gear box 14, which corresponds with a connection opening 18 that is arranged in a flange 19 provided within the area of the tip of the V-shaped arranged cylinder blocks 6.

Figure 2:
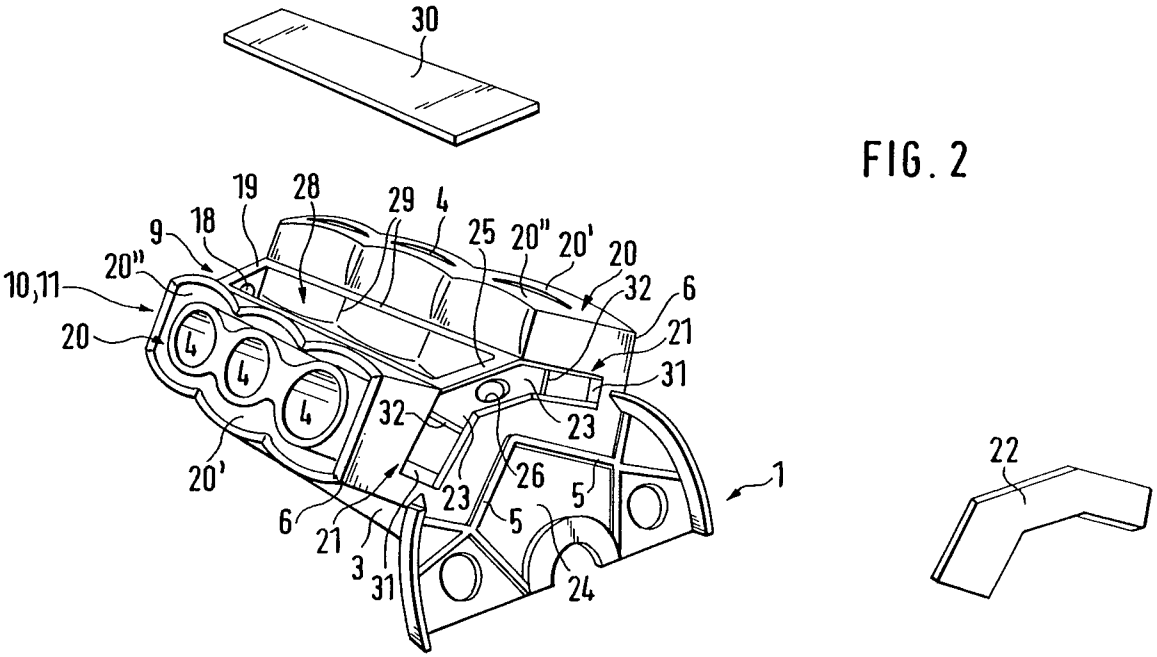
FIG. 2 is a perspective rear elevational view of the engine block according to FIG. 1 with further details.

The cylinder blocks 6 delimit cooling medium spaces 20 for the cylinders 4. Channels 21 are arranged at the other end of the engine block 1 remote from the cooling medium pump 11 for the inlet of the cooling medium to the cooling medium spaces 20 of the cylinder blocks 6 (FIG. 2). The channels 21 are constructed as recesses, respectively, apertures 23, in the end wall 24 of the engine block 1 on the of the clutch connection side which are adapted to be covered by a cover 22. A further flange 25 which is arranged near the end wall 24 within the area of the tip of the V-shaped arranged cylinder blocks 6 delimits the channels 21, respectively, recesses and includes an inlet opening 26 for the channels 21. A cooling medium line 28 which connects the channels 21, respectively, the inlet opening 26 with the pressure connection 17, respectively, with the connection opening 18 coordinated thereto is arranged between inner side walls 27 of the cylinder blocks 6 which side walls 27 are free of apertures and are operatively connected with the base plates 5 of the crankcase 3, respectively, with the cylinder blocks 6. The cooling medium line 28 is delimited by the flanges 19 and 25 as well as by the parts of the inner side walls 27 of the cylinder blocks 6 which abut at one another under an acute angle, whereby ledges 28 arranged at the inner side walls 27 between the flanges 19 and 25 together with the flanges form an abutment for a closure cover 30. In another embodiment, the cooling medium line may be a pipe (not shown) connecting the connection opening 18 of the forward flange 19 with the inlet opening 26 of the rear flange 25.

In order to achieve more uniform thermal stresses in the engine block 1, the orifices 31 of the channels 21 leading to the parts 20' on the exhaust gas side of the cooling medium spaces 20 of the cylinder block 6 are unthrottled as compared to the orifices 32 of the channels 21 of the parts 20'' on the air side. A prerequisite for greater cooling medium proportions in the exhaust gas side parts 20' of the cooling medium spaces 20 is created therewith.

For achieving a further simplification of the engine block 1 from a casting technical point of view, the cooling medium pump generally designated by reference numeral 11 (FIG. 1) which includes a radial rotor 31, is equipped with a housing 35 including a suction space and line connectios 32, 33 and 34. The cooling medium flowing back out of the cylinder heads of the internal combustion engine 2 flows in by way of the line connection 32. The line connection for the radiator inlet is designated by reference numeral 33 whereas the line connection for the radiator return is designated by reference numeral 34. The aforementioned line connections 32, 33 and 34 can be connected in a cooling medium conducting manner with a mixing chamber generally designated by reference numeral 36 containing a thermostat (not shown). Finally, the inlet from the mixing chamber 36 to the suction space (not shown) is designated by reference numberal 37, whereby the inlet 37 serves as by-pass line up to reaching the regulating temperature of the thermostat. In order to achieve a cooling medium pump which is accessible independently of the gear housing 8 of the chain- or toothed-belt transmission 7, the cooling medium pump 11 is arranged as a plug-in type component in the part 12 of the spiral housing 10 integrated into the closure wall 13 of the gear box 14. For that purpose, the part 12 of the spiral housing 10 is provided with an aperture 38 which is axially adjoined by a collar 39. The collar 39 at the gear box 14 cooperates by way of its inner circumference with a cylindrical collar 40 of the cooling medium pump 11. An O-ring arranged within the area of the collar 40 may serve for sealing the plug-in type cooling medium pump 11. A further side wall 41 is arranged at the gear box 14 spaced from the collar 39, which includes end-face a sealing surface 42 for the abutment of the cover 16. A separate seal is achieved therewith for the gear housing 8 of the chain- or toothed-belt transmission 7 with respect to the cooling medium pump 11. In addition to an independent accessibility of the cooling medium pump 11, on the one hand, and of the transmission 7, on the other, it is additionally achieved thereby that in case of a defective seal, a direct connection between the lubricating oil and the cooling medium is avoided.

Fastening means for the cooling medium pump 11 at the gear box 14 are not shown in the drawing for reasons of simplicity.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A cast engine block for liquid-cooled internal combustion engines having a V-shaped cylinder arrangement, comprising crankcase means, cylinder block means delimiting cooling medium spaces for cylinder means, base plate means connected with the cylinder means and operatively connecting the crankcase means with the cylinder block means, a spiral housing means for a cooling medium pump, said spiral housing means being at least partially integrated into an end wall of the engine block a separate closure part for the spiral housing means which includes a pressure connection with a connection opening between the cylinder block means directed toward the other end of the engine block, channel means for the cooling medium inlet to the cooling medium spaces of the cylinder block means arranged at the other end of the engine block remote from the cooling medium pump, cooling medium line means operatively connecting the channel means with the pressure connection and adapted to be arranged between inner side wall means of the cylinder block means operatively connected with the base plate means, said side wall means being substantially free of apertures, the cooling medium pump including a radial rotor operable to be assembled as plug-in component into the separate part of the spiral housing means by means of a housing including a suction space and a cooling medium line connection.

2. An engine block according to claim 1, in which cylinder heads adapted to be coordinated to the cylinder block means are constructed as cross-flow heads with an exhaust gas conduction on the outside of the internal combustion engine, the channel means being constructed as coverable recesses or apertures in an end wall of the engine block on the side of the clutch connection, the orifices of the channel means to the parts of the cooling medium spaces of the cylinder block means on the exhaust gas side being unthrottled compared to the orifices to the parts of the cooling medium spaces on the air side.

3. An engine block according to claim 2, wherein the cylinder heads operable to be coordinated to the cylinder housing means include control shafts adapted to be driven by a transmission means, a separate transmission housing for the transmission means provided at the pump side end wall of the engine block, the transmission housing including a gear box having a closure wall corresponding to at least the area of the end wall and including side walls essentially matched to the outer end wall contours as well as a separate cover, the separate part of the spiral housing means being integrated into closure wall, and the pressure connection of the separate part of the spiral housing means being adapted to be connected with a flange arranged in the area of the tip of the V-shaped arranged cylinder block means.

4. An engine block according to claim 3, wherein the part of the spiral housing integrated into the closure wall of the gear box includes an aperture means having an axially adjoining collar for mounting the cooling medium pump, the gear box including a further side wall arranged at a distance from said collar and having an end face sealing surface for the emplacement of the separate cover.

5. An engine block according to claim 4, wherein the gear box collar cooperates by way of its inner circumference with a cylindrical collar of the cooling medium pump, and an O-ring for sealing the plug-in arrangement.

6. An engine block according to claim 5, wherein a further flange within the area of the tip of the V-shaped arranged cylinder block means is arranged near the clutch side end wall, said further flange serving the common sealing connection of a cover means closing the channel means, respectively, the recesses, and an inlet opening for the channel means provided in said further flange.

7. An engine block according to claim 6, wherein the flanges are arranged in the end areas of the engine block, and wherein ledge means arranged at the inner side walls of the cylinder block means between the flanges form an abutment for a closure cover.

8. An engine block according to claim 1, wherein cylinder heads operable to be coordinated to the cylinder housing means include control shafts adapted to be driven by an envelope gear means, a separate transmission housing for the envelope gear means provided at the pump side end wall of the engine block, the transmission housing including a gear box having a closure wall corresponding to at least the area of the end wall and including side walls essentially matched to the outer end wall contours as well as a separate cover, the separate part of the spiral housing means being integrated into closure wall, and the pressure connection of the separate part of the spiral housing means being adapted to be connected with a flange arranged in the area of the tip of the V-shaped arranged cylinder block means.

9. An engine block according to claim 8, wherein the part of the spiral housing integrated into the closure wall of the gear box includes an aperture means having an axially adjoining collar for mounting the cooling medium pump, the gear box including a further side wall arranged at a distance from said collar and having an end face sealing surface for the emplacement of the separate cover.

10. An engine block according to claim 9, wherein the gear box collar cooperates by way of its inner circumference with a cylindrical collar of the cooling medium pump, and an O-ring for sealing the plug-in arrangement.

11. An engine block according to claim 10, wherein the pressure connection of the separate part of the spiral housing means is adapted to be connected with a flange arranged in the area of the tip of the V-shaped arranged cylinder block means.

12. An engine block according to claim 11, wherein a further flange within the area of the tip of the V-shaped arranged cylinder block means is arranged near the clutch side end wall, said further flange serving the common sealing connection of a cover means closing the channel means, respectively, the recesses, and an inlet opening for the channel means provided in said further flange.

13. An engine block according to claim 12, wherein the flanges are arranged in the end areas of the engine block, and wherein ledge means arranged at the inner side walls of the cylinder block means between the flanges form an abutment for a closure cover.

* * * * *